US006585209B1

(12) United States Patent
Mattingly

(10) Patent No.: US 6,585,209 B1
(45) Date of Patent: Jul. 1, 2003

(54) STORAGE BRACKET FOR FIREARMS

(76) Inventor: Ronald C. Mattingly, 2000 Old Calvary Pike, Lebanon, KY (US) 40033

( * ) Notice: Subject to any disclaimer, the term of this patent is extended or adjusted under 35 U.S.C. 154(b) by 0 days.

(21) Appl. No.: 10/122,719

(22) Filed: Apr. 15, 2002

Related U.S. Application Data

(60) Provisional application No. 60/292,404, filed on May 21, 2001.

(51) Int. Cl.[7] ..... A47F 5/00

(52) U.S. Cl. ..... 248/309.1; 47/70.11; 248/121

(58) Field of Search ..... 248/316.3, 309.2, 248/685, 309.1, 121, 122.1; 42/70.11, 70.01, 94

(56) References Cited

U.S. PATENT DOCUMENTS

| | | | | | |
|---|---|---|---|---|---|
| 225,530 | A | * | 3/1880 | McGlinchy | 211/14 |
| 1,113,530 | A | | 10/1914 | Audley | |
| 1,148,776 | A | * | 8/1915 | Hubbard | 248/122.1 |
| 1,579,552 | A | | 4/1926 | Ludlow | |
| 1,589,521 | A | * | 6/1926 | England | 248/312.1 |
| 2,060,543 | A | * | 11/1936 | White | 248/346.04 |
| 2,655,298 | A | | 10/1953 | Riley | |
| 2,727,325 | A | * | 12/1955 | Jurinic | 118/500 |
| 2,998,885 | A | | 9/1961 | Surface | |
| 3,346,228 | A | * | 10/1967 | Thorman | 211/89.01 |
| 3,559,935 | A | * | 2/1971 | Gardner | 211/14 |
| 3,637,180 | A | | 1/1972 | Parry | |
| 3,718,240 | A | | 2/1973 | Rose | |
| 4,569,144 | A | | 2/1986 | Thurber | |
| 4,846,384 | A | | 7/1989 | Perry | |
| 4,934,574 | A | | 6/1990 | Salandre | |
| 5,284,281 | A | | 2/1994 | Nichols | |
| 5,415,541 | A | * | 5/1995 | Kastingschafer et al. | 432/103 |
| 5,419,474 | A | | 5/1995 | Marx et al. | |
| 5,573,157 | A | | 11/1996 | Mauriello et al. | |
| 5,579,923 | A | | 12/1996 | Hemmerlein | |
| 5,621,996 | A | | 4/1997 | Mowl, Jr. | |
| 5,720,193 | A | | 2/1998 | Dick | |
| 5,768,816 | A | * | 6/1998 | Rassias | 42/70.11 |
| 5,791,499 | A | * | 8/1998 | Zebbedies | 211/64 |
| 6,122,851 | A | | 9/2000 | Perkins | |
| 6,128,847 | A | * | 10/2000 | Langner | 42/106 |
| 6,199,804 | B1 | * | 3/2001 | Donofrio, Jr. | 248/121 |

* cited by examiner

*Primary Examiner*—Kimberly Wood
(74) *Attorney, Agent, or Firm*—Stites & Harbison, PLLC; David W. Nagle, Jr.

(57) ABSTRACT

A storage bracket designed to secure and store a firearm is generally comprised of a frame and a spring-loaded stop that is adjustably secured to the frame. When inserting a firearm into the storage bracket, an individual inserts it barrel first such that the distal end of the barrel engages the stop. When the individual applies a force sufficient to overcome the force imparted on the stop by the spring, the result is compression of the spring and movement of the stop with respect to the frame that allows the rear portion of the firearm to be rotated into the storage bracket, with the rear portion of the firearm being received in and locked in the cavity defined by the frame.

17 Claims, 5 Drawing Sheets

STORAGE BRACKET FOR FIREARMS

CROSS REFERENCES TO RELATED APPLICATIONS

This application claims priority from U.S. Provisional Application Serial No. 60/292,404 filed May 21, 2001, and relates to a storage bracket that provides a safe manner in which to store a firearm, such as a hand gun. The entire disclosure contained in U.S. Provisional Application Serial No. 60/292,404 is incorporated herein by this reference.

BACKGROUND OF THE INVENTION

The present invention is a storage bracket that provides a safe manner in which to store a firearm, such as a hand gun, yet allows for simple and rapid access to the firearm in an emergency situation.

Firearm safety has always been an important issue to individuals who regularly carry and use firearms, including law enforcement personnel, military personnel, and sportsmen. Those who regularly use firearms generally recognize the value and importance of proper education, training, and practice in the use, cleaning, and storage of firearms. In addition, persons who carry firearms recognize the need to keep the firearm secured until such time as they actively withdraw it for use. Unfortunately, there have been tragic accidents in which children or others have accidentally injured themselves or others because a firearm was stored without observing appropriate safety precautions. As a result, various safety devices have been developed, including, for example, gun locks or security holsters.

A common gun lock mechanically prevents a firearm from being discharged and thus prevents accidental discharge by a child or other inexperienced person. Some gun locks engage the muzzle, others engage and immobilize the trigger, and others immobilize the slide of a handgun. Many such prior art gun locks are described in detail in U.S. Pat. No. 6,122,851 issued to Perkins. For its description of prior art gun locks, U.S. Pat. No. 6,122,851 is incorporated herein by reference.

Security holsters, often used by police officers, are another means by which to effectively store and secure a firearm so as to prevent an assailant from accessing the gun for use against an officer. At the same time, security holsters must allow for simple and rapid access to the firearm when the need arises. Many prior art security holsters are described in U.S. Pat. No. 5,284,281 issued to Nichols. For its description of prior art security holsters, U.S. Pat. No. 5,284,281 is incorporated herein by reference.

However, there are still many drawbacks and disadvantages associated with prior art safety devices, such as gun locks and security holsters. For example, many devices are complex and cumbersome, and therefore prevent an individual from rapidly and effortlessly accessing his firearm for firing in an emergency situation, such as when an intruder enters his home or when an imminent danger is confronted.

Therefore, it is a paramount object of the present invention to provide an improved safety device, specifically a storage bracket, that provides a safe manner in which to store a firearm, such as a hand gun, yet allows for simple and rapid access to the firearm in an emergency situation.

This and other objects and advantages of the present invention will become apparent upon a reading of the following description.

SUMMARY OF THE INVENTION

The present invention is a storage bracket designed to secure and store a firearm in a safe manner, yet allows for simple and rapid access to the firearm in an emergency situation. A preferred storage bracket is generally comprised of a frame and a spring-loaded stop that is adjustably secured to the frame. The frame is generally C-shaped, with a long spine portion, two appendages extending from the distal ends of the spine portion, and perhaps most importantly, a substantially perpendicular extension from the first appendage, such that a cavity is defined between the spine portion and the perpendicular extension of the frame.

Secured to the second appendage of the frame is the spring-loaded stop. The stop is preferably secured to the second appendage using a nut-and-bolt arrangement, with a spring being interposed between the stop and the second appendage of the frame. This spring maintains the vertical distance between the stop and second appendage, but also allows for movement of the stop with respect to the second appendage.

When inserting a firearm into the storage bracket, an individual inserts it barrel first such that the distal end of the barrel engages the stop. When the individual applies a force sufficient to overcome the force imparted on the stop by the spring, the result is compression of the spring and movement of the stop with respect to the frame such that the rear portion of the firearm can be rotated into the storage bracket. Specifically, simultaneous with the movement of the stop, the individual pushes the rear portion of the hand gun forward toward the spine portion of the frame, essentially rotating the firearm about a pivot point defined by the contact of the barrel of the firearm with the stop. This movement of the firearm continues until the rear portion of the firearm clears the perpendicular extension of the first appendage of the frame. The individual then ceases to apply a force against the stop, and the biasing force of the spring presses the firearm away from the second appendage of the frame, locking the firearm into the storage bracket with the rear portion of the firearm being received in and locked in the cavity defined between the spine portion and the perpendicular extension of the frame.

DETAILED DESCRIPTION OF THE INVENTION

The present invention is a storage bracket designed to secure and store a firearm in a safe manner, yet allows for simple and rapid access to the firearm in an emergency situation. Referring first to the perspective view of FIG. 1, a preferred storage bracket 10 in accordance with the present invention is incorporated into a holster 12 for a hand gun 14. The holster 12 is essentially a covering made of a flexible fabric, such as a woven fabric or nylon, and preferably encloses the storage bracket 10 and body of a stored hand gun 14, leaving only the grip of the hand gun 14 exposed. By so enclosing the hand gun 14, it can not be pulled from the storage bracket 10 by its barrel 14*a* since only the grip is exposed. Such a construction allows the holster 12 to store and secure the hand gun 14 independently, or the holster 12 can be worn as a conventional holster by attaching in some fashion to an individual, such as by proving the holster 12 with loops or slots for accommodating a belt. In any event, it is contemplated that the holster 12 could be excluded entirely from the embodiments as shown in FIGS. 1–4, leaving a stand-alone storage bracket 10 without departing from the spirit and scope of the present invention.

Figure 1:
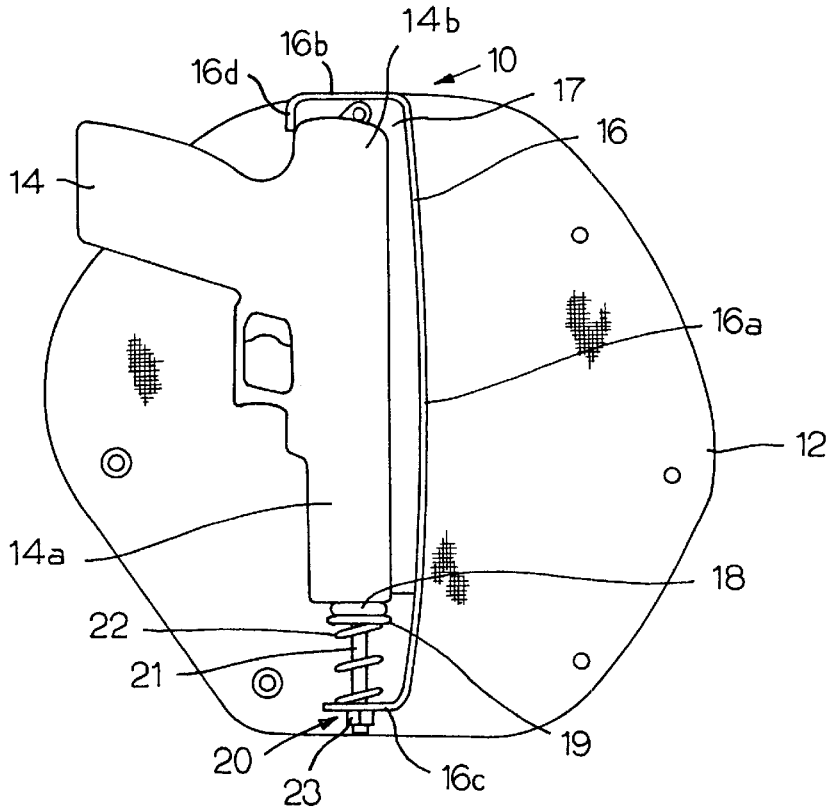
FIG. 1 is a perspective view of a preferred storage bracket made in accordance with the present invention and incorporated into a holster constructed of a flexible fabric, a hand gun being received and retained in said storage bracket.

Referring still to FIG. 1, the preferred storage bracket 10 is generally comprised of a frame 16 and a spring-loaded stop 19 that is adjustably secured to the frame 16. The frame 16 is preferably constructed of a rigid material, such as a metal or sturdy plastic, that can withstand repeated insertion, storage and removal of a hand gun 14. The frame 16 is generally C-shaped, with a long spine portion 16*a*, and two appendages 16*b*, 16*c* extending from the distal ends of the spine portion 16*a*. Perhaps most importantly, the first appendage 16*b* has a substantially perpendicular extension 16*d* (which is also oriented substantially parallel to the spine portion 16*a* of the frame 16) such that a cavity 17 is defined between the spine portion 16*a* and the perpendicular extension 16*d* of the frame 16, as will be described in further detail below.

Secured to the second appendage 16*c* of the frame 16 is the spring-loaded stop 19. In the preferred embodiment shown, the stop 19 is adjustably secured to the second appendage 16*c* using a nut-and-bolt arrangement (generally indicated by reference numeral 20), with a spring 22 interposed between the stop 19 and the second appendage 16*c* of the frame 16. Specifically, a bolt 21 passes through an opening defined through the stop 19 with the enlarged head of the bolt 21 engaging the upper surface of the stop 19. The distal threaded end of the bolt 21 then passes through an opening defined through the second appendage 16*c* of the frame 16, and is secured with respect to the frame 16 by a nut 23. The spring 22 interposed between the stop 19 and the second appendage 16*c* of the frame 16 maintains the vertical distance between the stop 19 and second appendage 16*c*. Use of such a nut-and-bolt arrangement 20 allows for fine adjustments of position of the stop 19 with respect to the second appendage 16*c* through adjustment of the position of the nut 23 along the length of the bolt 21, and also facilitates replacement of the spring 22 when necessary.

As a further refinement, and as shown in FIG. 1, the upper surface of the stop 19 may be provided with a pad 18, preferably made of rubber or a similar material, to cushion the barrel 14*a* of the hand gun 14, thereby reducing the likelihood of damage to the gun barrel 14*a* as it is inserted into or stored in the storage bracket 10. In this regard, the preferred pad 18 also covers the enlarged head of the bolt 21 engaging the upper surface of the stop 19.

Figure 2:
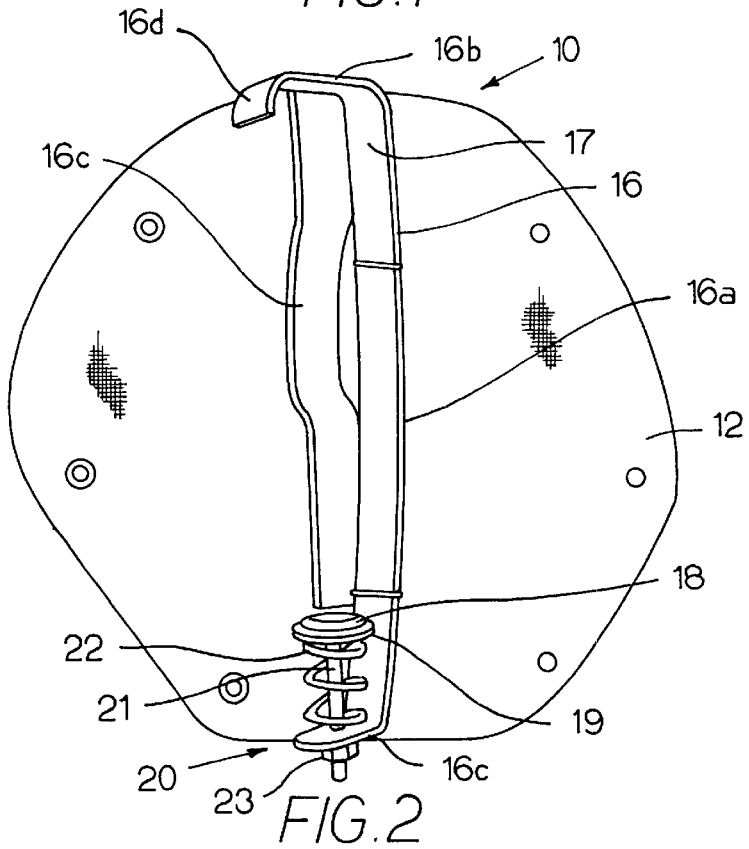
FIG. 2 is a perspective view of a second preferred storage bracket made in accordance with the present invention and also incorporated into a holster constructed of a flexible fabric.

FIG. 2 shows a second preferred embodiment of a storage bracket 10 made in accordance with the present invention in which the frame 16 further comprises a single side wall 16*e* adjacent and substantially perpendicular to the spine portion 16*a*, first appendage 16*b*, and second appendage 16*c*. This side wall 16*e* stabilizes a hand gun 14 in the storage bracket 10, restricting side-to-side movement of a hand gun 14 within the storage bracket 10. As with the other components of the frame 16, the side wall 16*e* is also preferably constructed of a rigid material, such as a metal or sturdy plastic.

Figure 3:
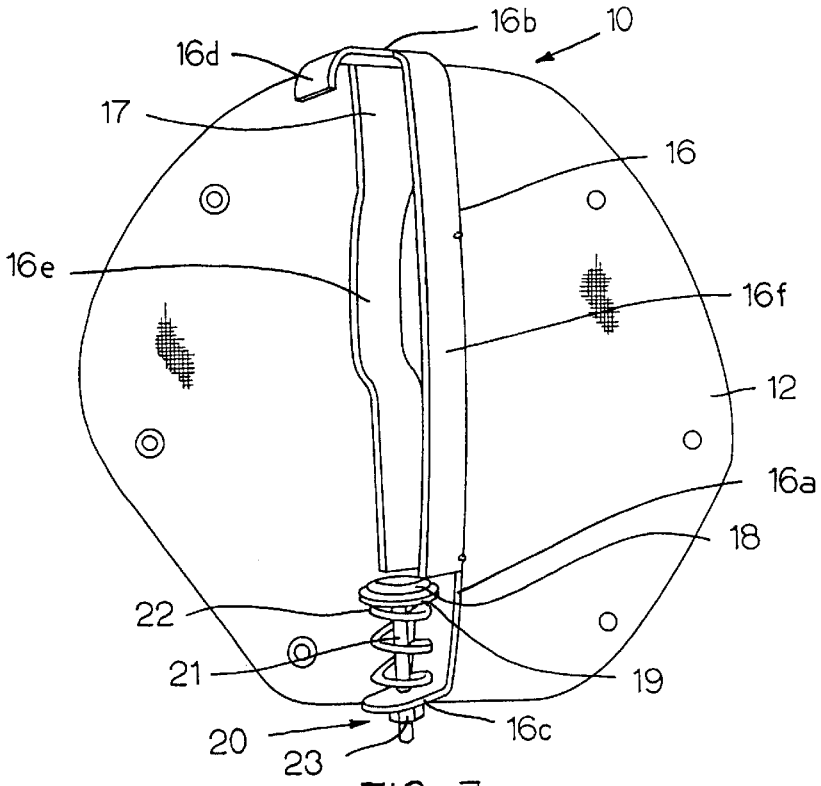
FIG. 3 is a perspective view of a third preferred storage bracket made in accordance with the present invention and also incorporated into a holster constructed of a flexible fabric.

FIG. 3 shows a third preferred embodiment of a storage bracket 10 made in accordance with the present invention in which the frame 16 further comprises opposing, parallel side walls 16*e*, 16*f* adjacent and substantially perpendicular to the spine portion 16*a*, first appendage 16*b*, and second appendage 16*c*. These side wall 16*e*, 16*f* also stabilize a hand gun 14 in the storage bracket 10, further restricting side-to-side movement of a hand gun 14 within the storage bracket 10. As with the other components of the frame 16, the side walls 16*e*, 16*f* are also preferably constructed of a rigid material, such as a metal or sturdy plastic.

Figure 4:
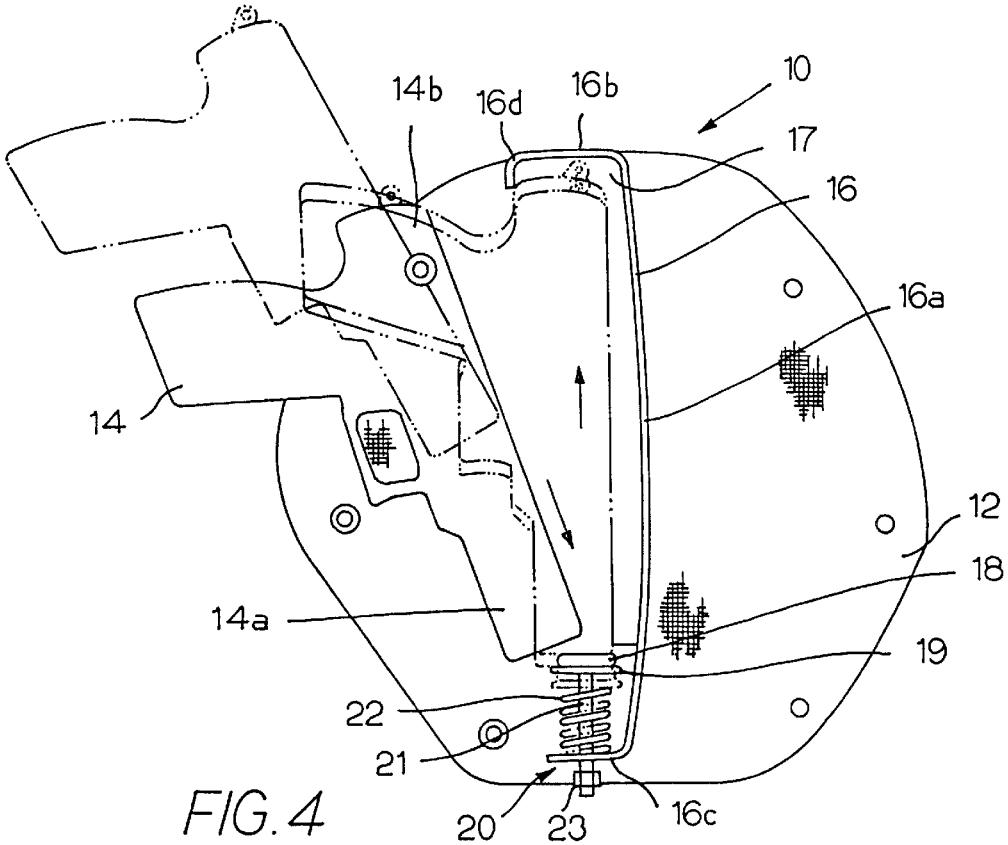
FIG. 4 is a perspective view of the preferred storage bracket of FIG. 1, illustrating the motion necessary for removal or insertion of the hand gun with respect to the storage bracket.

FIG. 4 illustrates the motion necessary for removal or insertion of the hand gun 14 with respect to the storage bracket 10 of the present invention. As shown in FIG. 4, when inserting the hand gun 14 into the storage bracket 10, an individual inserts it barrel first such that the distal end of the barrel 14*a* engages the stop 19. In this regard, the spring 22 biases the stop 19 into a first position. When the individual applies a force sufficient to overcome the force imparted on the stop 19 by the spring 22, the result is compression of the spring 22 and downward movement of the stop 19 with respect to the frame 16 and to a second position that allows the rear portion 14*b* of the hand gun 14 to be rotated into the storage bracket 10. Specifically, simultaneous with the downward movement of the stop 19, the individual pushes the rear portion of the hand gun 14 forward toward the spine portion 16*a* of the frame 16, essentially rotating the hand gun 14 about a pivot point defined by the contact of the barrel 14*a* of the hand gun 14 with the stop 19. The downward and forward movement of the gun 14 continues until the rear portion 14*b* of the gun clears the perpendicular extension 16*d* of the first appendage 16*b* of the frame 16. The individual then ceases to apply a downward force against the stop 19, and the biasing force of the spring 22 presses the hand gun 14 upward with respect to the frame 16, locking it into the storage bracket 10. In other words, the rear portion 14*b* of the hand gun 14 is received in and locked in the cavity 17 defined between the spine portion 16*a* and the perpendicular extension 16*d* of the frame 16, thereby preventing the hand gun 14 from being simply pulled from the storage bracket 10.

To remove the hand gun 14 from the bracket 10 requires that the hand gun 14 first be pressed downwardly against the stop 19 with sufficient force to overcome the biasing force of spring 22 and until the rear portion 14*b* of the gun clears the perpendicular extension 16*d* of the first appendage 16*b* of the frame 16 so that it can be withdrawn. Of course, removal of the hand gun 14 in this manner requires some knowledge of the mechanics of the storage bracket 10 and runs counter to the conventional "pulling" motion required to withdraw a hand gun 14 from a conventional holster. In this regard, incorporating the storage bracket 10 of the present invention into holsters for law enforcement personnel would prevent a hand gun from being withdrawn and used against an officer in a struggle with a criminal offender, yet, with knowledge of the mechanics of the storage bracket 10, the officer would still be able to have simple and rapid access to his hand gun.

Figure 5:
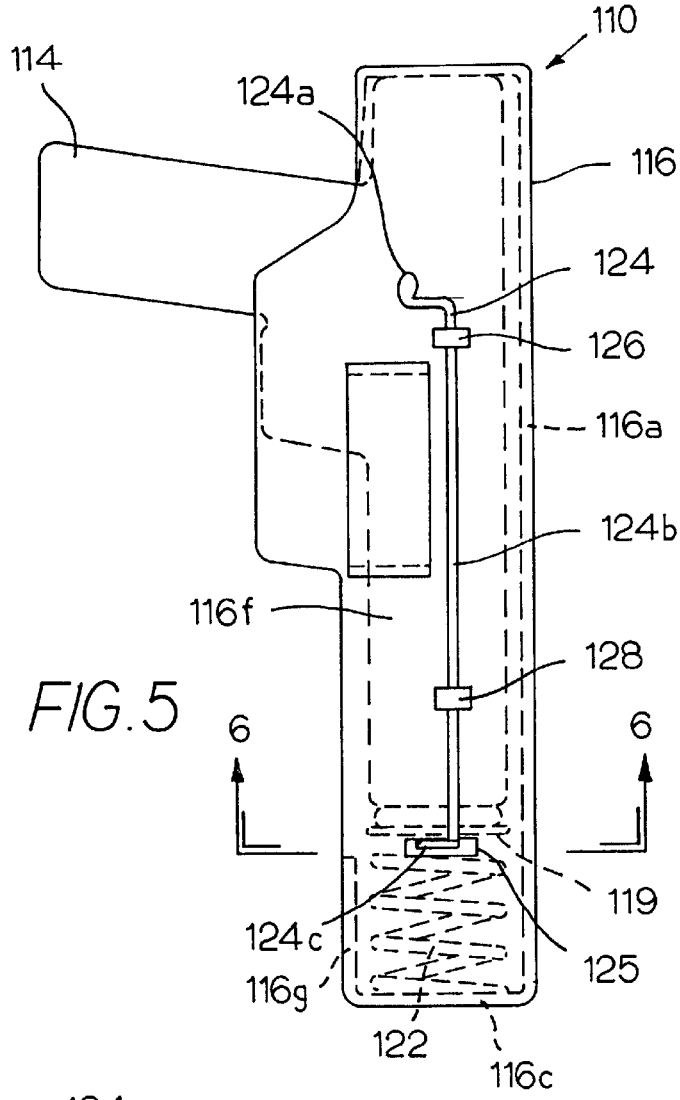
FIG. 5 is a side view of another preferred storage bracket made in accordance with the present invention.
Figure 6:
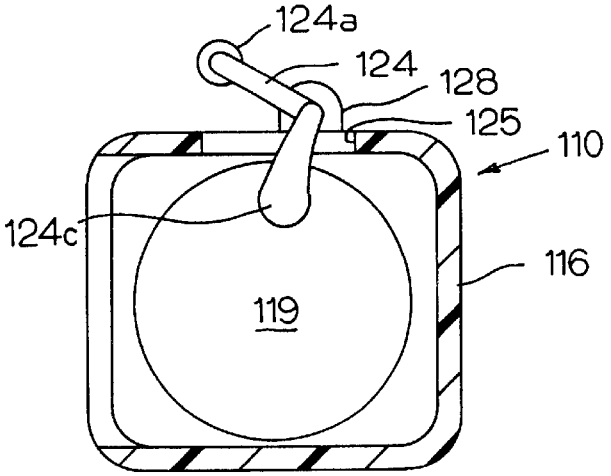
FIG. 6 is a sectional view of the preferred storage bracket of FIG. 5 taken along line 6—6 of FIG. 5.

FIGS. 5 and 6 illustrate another preferred embodiment of the present invention. In this embodiment, the storage bracket 110 has a frame 116 with a double-walled construction similar to that described with respect to FIG. 3, except that in this embodiment, the spring 122 is not secured to the frame 116 through any type of nut-and-bolt arrangement. Instead, the second appendage 116*c* of the frame also has a substantially perpendicular extension 116*g* at its distal end. Therefore, there is a cavity defined and enclosed by the spine portion 116*a*, second appendage 116*c*, opposing side walls 116*e*, 116*f*, and the substantially perpendicular extension 116*g* in which the spring 122 is mounted.

As a further refinement, the storage bracket 110 illustrated in FIGS. 5 and 6 also includes a thumb lever 124 which can be selectively rotated to prevent depression of the stop 119 against the spring 122 thus preventing withdrawal of the hand gun 124 from the storage bracket 110. Specifically the thumb lever 124 comprises a central shaft 124*b*, with an integral thumb key 124*a* at the upper distal end of the shaft 124*b* and an integral locking member 124*c* at the lower distal end of the shaft 124*b*. The thumb lever 124 is rotatably mounted to the storage bracket 110, preferably by threading the shaft 124*b* through two mounts 126, 128 which are secured to the side wall 116*f* of the frame 116 of the storage bracket 110. Although not shown in the Figures, the shaft 124*b* of the thumb lever 124 may be provided with enlarged diameter portions adjacent the mounts 126, 128 that substantially restrict vertical movement of the thumb lever 124 with respect to the storage bracket 110. When the thumb key 124*a* is rotated to the position illustrated in FIGS. 5 and 6, the associated locking member 124*c* is positioned below the stop 119, thus preventing any depression of the stop 119 and further reducing the likelihood of any accidental or unwanted release of the hand gun 114 from the bracket 110. In this regard, and as shown in FIG. 5, an opening 125 is defined through the side wall 116*f* of the frame 116 to allow the locking member 124*c* to engage the stop 119. Of course, to withdraw the hand gun, the thumb key 124*a* is rotated until the locking member 124*c* is moved out from its position under the stop 119, thus allowing for the withdraw of the hand gun 124 as described above with reference to FIG. 4.

Figure 7:
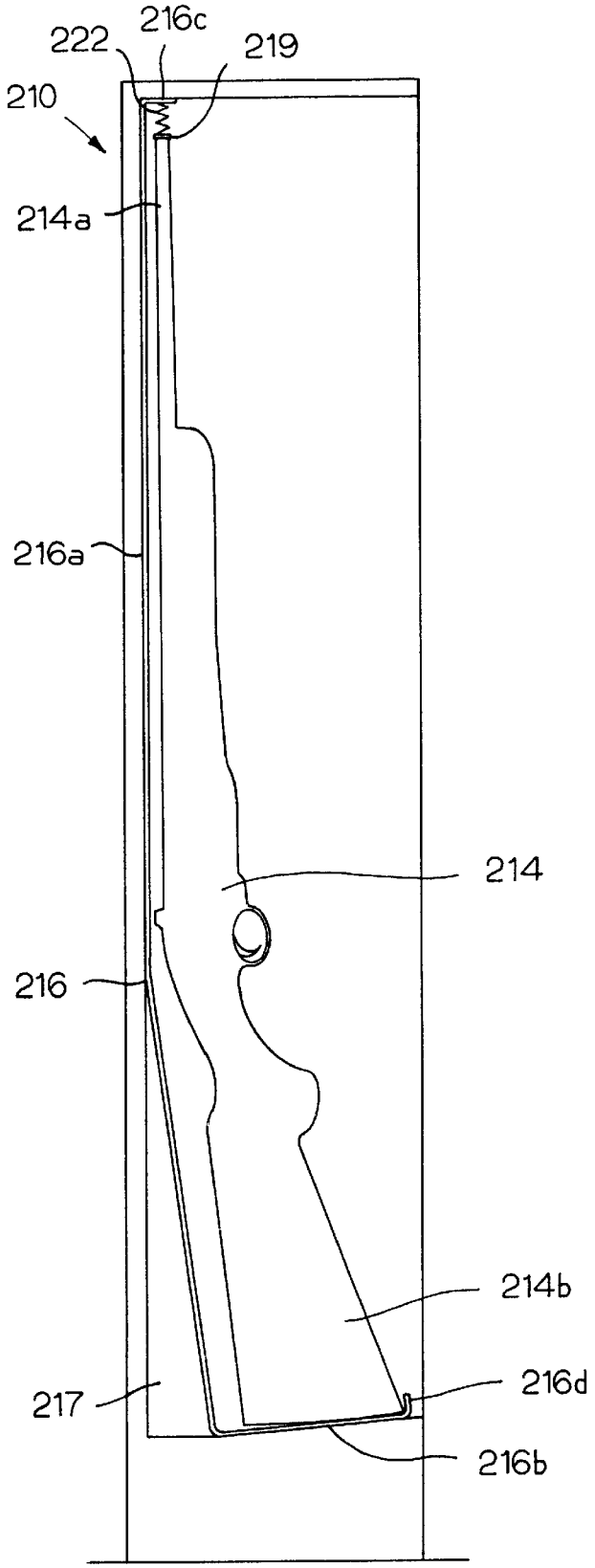
FIG. 7 is a side view of a storage bracket made in accordance with the present invention and incorporated into a firearm cabinet, a rifle being received and retained in said storage bracket.
Figure 8:
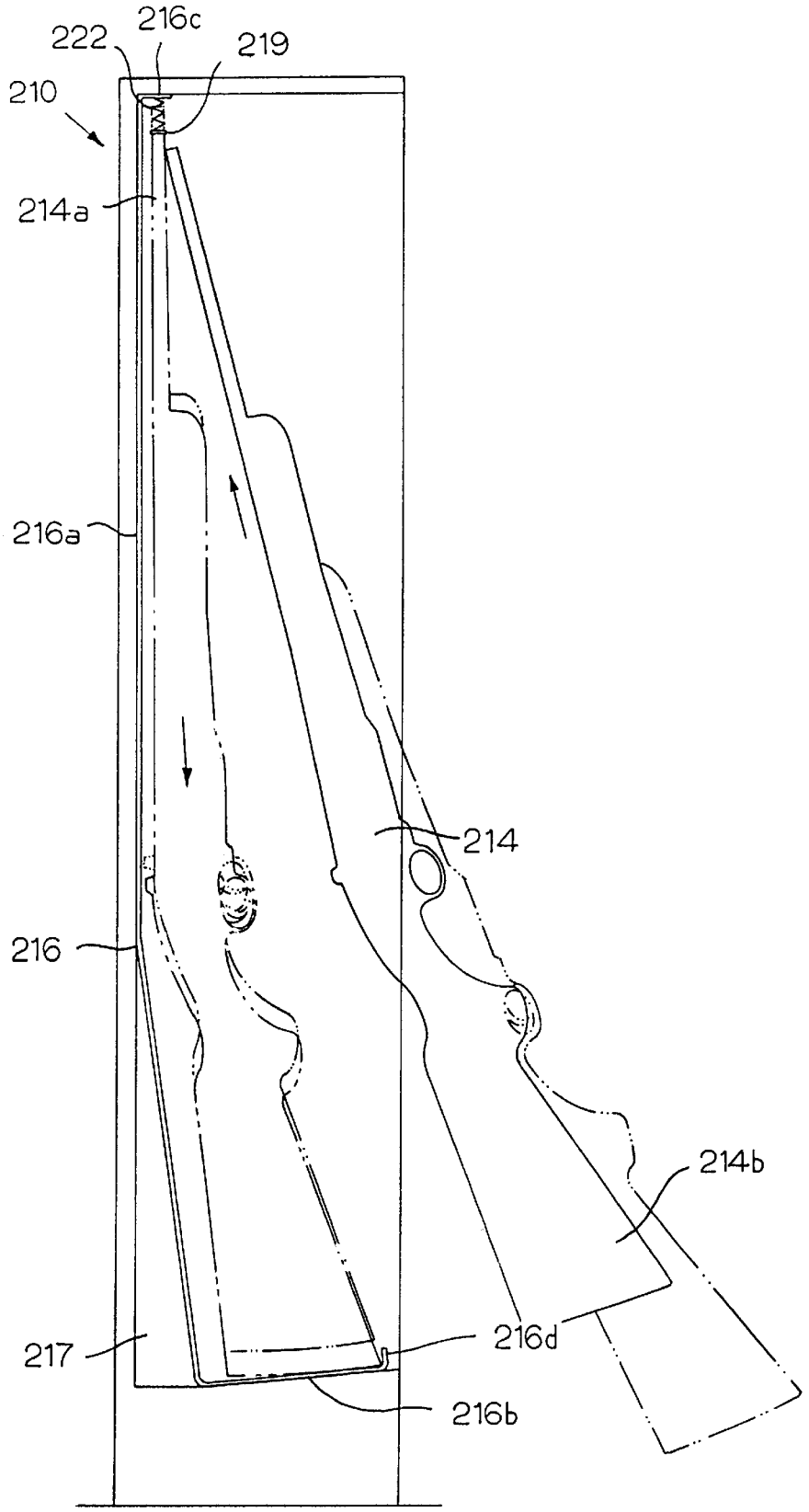
FIG. 8 is a side view of the storage bracket of FIG. 7, illustrating the motion necessary for removal or insertion of the rifle with respect to the storage bracket.

Although FIGS. 1–6 depict the storage bracket 10 of the present invention as used for storage of a hand gun 14, the present invention is not limited to such an embodiment. Indeed, it is contemplated and preferred that the present invention could be used for the storage of a long gun, such as a shotgun or a rifle. FIGS. 7–8 illustrate an alternate embodiment of a storage bracket 210 made in accordance with the present invention and incorporated into a firearm cabinet, a rifle being received and retained in the storage bracket 210. Again, the storage bracket 210 is generally comprised of a frame 216 and a spring-loaded stop 219 that is secured to the frame 216. The frame 216 is preferably constructed of a rigid material, such as a metal or sturdy plastic, that can withstand repeated insertion, storage and removal of a rifle or similar long gun 214. The frame 216 is generally C-shaped, with a long spine portion 216*a*, and two appendages 216*b*, 216*c* extending from the distal ends of the spine portion 216*a*. The first appendage 216*b* has a substantially perpendicular extension 216*d* such that a cavity 217 is defined between the spine portion 216*a* and the perpendicular extension 216*d* of the frame 216. Thus, as illustrated in FIG. 8, when inserting the rifle 214 into the storage bracket 210, an individual inserts it barrel first such that the distal end of the barrel 214*a* engages the stop 219. The individual applies a force sufficient to overcome the force imparted on the stop 219 by the spring 222, thereby causing compression of the spring 222 and upward movement of the stop 219 with respect to the frame 216. Simultaneous with the upward movement of the stop 219, the individual pushes the stock of the rifle 214 forward toward the spine portion 216*a* of the frame 216, essentially rotating the rifle 214 about a pivot point defined by the contact of the barrel 214*a* of the rifle 214 with the stop 219. The upward and forward movement of the rifle 214 continues until the stock 214*b* of the rifle clears the perpendicular extension 216*d* of the first appendage 216*b* of the frame 216. The individual then ceases to apply an upward force against the stop 219, and the biasing force of the spring 222 presses the rifle 214 downward with respect to the frame 216, locking it into the storage bracket 210. In other words, the stock 214*b* of the rifle 214 is received in and locked in the cavity 217 defined between the spine portion 216*a* and the perpendicular extension 216*d* of the frame 216, thereby preventing the rifle 214 from being simply pulled from the storage bracket 210.

It will be obvious to those skilled in the art that other modifications may be made to the invention as described herein without departing from the spirit and scope of the present invention.

What is claimed is:

1. A storage bracket for a firearm having a barrel and a rear portion, comprising:

a C-shape frame, including a spine portion, a first appendage secured to a first distal end of said spine portion, a second appendage secured to a second distal end of said spine portion, and a substantially perpendicular extension secured to the distal end of said first appendage and orientated substantially parallel to said spine portion such that a cavity is defined between said spine portion and said perpendicular extension, and said cavity being adapted to receive the rear portion of said firearm; and a stop secured to the second appendage of said frame, said stop being adapted for movement with respect to said frame and biased into a first position, wherein the barrel of said firearm can be pressed against said stop to move the stop from said first position to a second position that allows the rear portion of said firearm to be rotated into the storage bracket, said stop then returning to substantially said first position with the rear portion of said firearm being received and locked in the cavity defined between the spine portion and the perpendicular extension of said frame.

2. A storage bracket for a firearm as recited in claim 1, wherein said stop is biased into said first position by a spring interposed between said stop and the second appendage of said frame.

3. A storage bracket for a firearm as recited in claim 2, wherein a bolt with an enlarged head and threaded end passes through an opening defined through said stop, the enlarged head of said bolt engaging the upper surface of the stop, and the threaded end of said bolt passing through an opening defined through the second appendage of said frame, said bolt being secured with respect to said frame by a nut, and said spring being interposed between said stop and the second appendage of said frame around said bolt.

4. A storage bracket for a firearm as recited in claim 1, wherein said frame further includes a side wall adjacent and substantially perpendicular to said spine portion, said first appendage, and said second appendage, said side wall restricting side-to-side movement of the firearm within the storage bracket.

5. A storage bracket for a firearm as recited in claim 1, wherein said frame further includes opposing, parallel side walls adjacent and substantially perpendicular to said spine portion, said first appendage, and said second appendage, said side walls restricting side-to-side movement of the firearm within the storage bracket.

6. A storage bracket for a firearm as recited in claim 1, wherein said storage bracket is incorporated into and substantially enclosed within a holster.

7. A storage bracket for a firearm as recited in claim 1, wherein said storage bracket is incorporated into a firearm cabinet.

8. A storage bracket for a firearm as recited in claim 1, wherein a pad is secured to the upper surface of said stop to cushion the barrel of said firearm, thereby reducing the likelihood of damage to the barrel of said firearm.

9. A storage bracket for a firearm having a barrel and a, rear portion, comprising:

a frame, including a spine portion, a first appendage secured to a first distal end of said spine portion, a second appendage secured to a second distal end of said spine portion, a substantially perpendicular extension secured to the distal end of said first appendage and orientated substantially parallel to said spine portion such that a cavity is defined between said spine portion and said perpendicular extension, and said cavity being adapted,to receive the rear portion of said firearm, and a side wall adjacent and substantially perpendicular to said spine portion, said first appendage, and said second appendage, said side wall restricting side-to-side movement of the firearm within the storage bracket;

a stop secured to the second appendage of said frame, said stop being adapted for movement with respect to said frame and biased into a first position, wherein the barrel of said firearm can be pressed against said stop to move the stop from said first position to a second position that allows the rear portion of said firearm to be rotated into the storage bracket, said stop then returning to substantially said first position with the rear portion of said firearm being received and locked in the cavity defined between the spine portion and the perpendicular extension of said frame; and a thumb lever which can be selectively rotated to prevent depression of the stop, thus preventing withdrawal of the firearm from the storage bracket.

10. A storage bracket for a firearm as recited in claim 9, wherein said thumb lever comprises a central shaft, with an integral thumb key at the upper distal end of the shaft and an integral locking member at the lower distal end of the shaft, said thumb lever being rotatably mounted to the storage bracket, the rotation of said thumb key causing movement of the associated locking member for engaging and disengaging said stop.

11. A storage bracket for a firearm as recited in claim 10, wherein said thumb lever is rotatably mounted to the storage bracket by threading the shaft of said thumb lever through at least two mounts secured to the side wall of the frame of said storage bracket, the shaft of said thumb lever being provided with enlarged diameter portions adjacent the mounts that substantially restrict vertical movement of said thumb lever with respect to said storage bracket.

12. A storage bracket for a firearm having a barrel and a rear portion, comprising:

a C-shaped frame, including a spine portion, a first appendage secured to a first distal end of said spine portion, a second appendage secured to a second distal end of said spine portion, and a substantially perpendicular extension secured to the distal end of said first appendage and orientated substantially parallel to said spine portion such that a cavity is defined between said spine portion and said perpendicular extension, said cavity being adapted to receive the rear portion of said firearm; and a stop secured to the second appendage of said frame, said stop being adapted for movement with respect to said frame and biased into a first position by a spring interposed between said stop and the second appendage of said frame, wherein the barrel of said firearm can be pressed against said stop with sufficient force to overcome the force imparted on the stop by said spring, resulting in compression of said spring and downward movement of said stop with respect to said frame such that the rear portion of said firearm can be rotated into the storage bracket, the biasing force of said spring then pressing said firearm into said storage bracket with the rear portion of said firearm being received and locked in the cavity defined between the spine portion and the perpendicular extension of said frame.

13. A storage bracket for a firearm as recited in claim 12, wherein a bolt with an enlarged head and threaded end passes through an opening defined through said stop, the enlarged head of said bolt engaging the upper surface of the stop, and the threaded end of said bolt passing through an opening defined through the second appendage of said frame, said bolt being secured with respect to said frame by a nut, and said spring being interposed between said stop and the second appendage of said frame around said bolt.

14. A storage bracket for a firearm as recited in claim 12, wherein said frame further includes a side wall adjacent and substantially perpendicular to said spine portion, said first appendage, and said second appendage, said side wall restricting side-to-side movement of the firearm within the storage bracket.

15. A storage bracket for a firearm as recited in claim 12, wherein said frame further includes opposing, parallel side walls adjacent and substantially perpendicular to said spine portion, said first appendage, and said second appendage, said side walls restricting side-to-side movement of the firearm within the storage bracket.

16. A storage bracket for a firearm as recited in claim 12, wherein a pad is secured to the upper surface of said stop to cushion the barrel of said firearm, thereby reducing the likelihood of damage to the barrel of said firearm.

17. A storage bracket for a firearm having a barrel and a rear portion, comprising:

a frame, including a spine portion, a first appendage secured to a first distal end of said spine portion, a second appendage secured to a second distal end of said spine portion, first and second opposing side walls adjacent and substantially perpendicular to said spine portion, said first appendage, and said second appendage, a first substantially perpendicular extension secured to the distal end of said first appendage and orientated substantially parallel to said spine portion such that a first cavity is defined and enclosed by said spine portion, said first appendage, said first and second opposing side walls, and said first substantially perpendicular extension, said first cavity being adapted to receive the rear portion of said firearm, and a second substantially perpendicular extension secured to the distal end of said second appendage and orientated substantially parallel to said spine portion such that a second cavity is defined and enclosed by said spine portion, said second appendage, said first and second opposing side walls, and said substantially perpendicular extension; and a stop secured to the second appendage of said frame, said stop being adapted for movement with respect to said frame and biased into a first position by a spring housed in said second cavity, wherein the barrel of said firearm can be pressed against said stop with sufficient force to overcome the force imparted on the stop by said spring, resulting in compression of said spring and downward movement of said stop with respect to said frame such that the rear portion of said firearm can be rotated into the storage bracket, the biasing force of said spring then pressing said firearm into said storage bracket with the rear portion of said firearm being received and locked in the first cavity.

* * * * *